US006252934B1

(12) United States Patent
Scott et al.

(10) Patent No.: US 6,252,934 B1
(45) Date of Patent: Jun. 26, 2001

(54) APPARATUS AND METHOD FOR COOLING A STRUCTURE USING BOILING FLUID

(75) Inventors: Allan W. Scott, Los Altos; Gary E. Haddox, Sacramento; Philip M. Lally; Yehuda Goren, both of Palo Alto, all of CA (US)

(73) Assignee: Teledyne Technologies Incorporated, Los Angeles, CA (US)

( * ) Notice: Subject to any disclaimer, the term of this patent is extended or adjusted under 35 U.S.C. 154(b) by 0 days.

(21) Appl. No.: 09/265,176

(22) Filed: Mar. 9, 1999

(51) Int. Cl.[7] ..... H01J 35/10

(52) U.S. Cl. ..... 378/130; 378/141; 165/164

(58) Field of Search ..... 378/119, 121, 378/125, 127, 129, 130, 141, 144, 199, 200; 165/164, 185

(56) References Cited

U.S. PATENT DOCUMENTS

| | | | | |
|---|---|---|---|---|
| 2,111,412 | | 3/1938 | Ungelenk | 250/35 |
| 2,493,606 | | 1/1950 | Waterton | 250/148 |
| 3,546,511 | | 12/1970 | Shimula | 313/32 |
| 4,165,472 | | 8/1979 | Wittry | 313/35 |
| 4,455,504 | | 6/1984 | Iversen | 313/30 |
| 4,577,340 | * | 3/1986 | Carlson et al. | 378/132 |
| 4,584,699 | | 4/1986 | LaFiandra et al. | 378/130 |
| 4,622,687 | * | 11/1986 | Whitaker et al. | 378/130 |
| 4,688,239 | * | 8/1987 | Schaffner et al. | 378/141 |
| 4,788,705 | | 11/1988 | Anderson | 378/121 |
| 4,828,022 | * | 5/1989 | Koehler et al. | 165/185 |
| 4,928,296 | | 5/1990 | Kadambi | 378/141 |
| 4,988,392 | | 1/1991 | Nicholson et al. | 148/11.5 |
| 5,056,127 | | 10/1991 | Iversen et al. | 378/130 |
| 5,173,931 | | 12/1992 | Pond | 378/130 |
| 5,295,175 | | 3/1994 | Pond | 378/130 |
| 5,541,975 | | 7/1996 | Anderson et al. | 378/130 |
| 5,737,387 | | 4/1998 | Smither | 378/130 |

FOREIGN PATENT DOCUMENTS

| | | | |
|---|---|---|---|
| 60039747 | 1/1985 | (EP) | H01J/35/10 |
| 0 293 791 A1 | 7/1988 | (EP) | H01J/35/10 |
| WO 82/03522 | 10/1982 | (WO) | H05G/1/02 |
| WO 83/02850 | 8/1983 | (WO) | H01J/35/04 |

* cited by examiner

*Primary Examiner*—David P. Porta
(74) *Attorney, Agent, or Firm*—Kirkpatrick & Lockhart LLP

(57) ABSTRACT

A cooling apparatus and method for cooling a structure using boiling fluid acted upon by centrifugal force. The cooling apparatus has an actuator with a shaft, a heat transfer member with a heat transfer surface and a fluid passageway connected to the shaft and in thermal communication with the structure. The cooling apparatus can be used to cool the anode of an x-ray tube.

44 Claims, 8 Drawing Sheets

APPARATUS AND METHOD FOR COOLING A STRUCTURE USING BOILING FLUID

BACKGROUND OF THE INVENTION

1. Field of the Invention

The present invention is directed generally to a method and apparatus for cooling a structure using boiling fluid. More particularly, the present invention concerns a method and apparatus for cooling a structure having an actuator with a shaft and a fluid passageway connected to the shaft and in thermal communication with the structure.

2. Description of the Background

The need for an effective cooling apparatus exists in the field of x-ray tube technology. Conventional x-ray devices typically generate x-rays by an electron beam bombarding an anode. The anode is rotated at high speeds in order to distribute the heat that is generated by the impact of the electron beam over the surface of the anode. The electron beam striking the anode causes the temperature of the anode to increase. After a short period of operation, the x-ray tube must be shut-off for the anode to cool.

In the situation where the x-ray tube is used in a CT scanner, the x-ray tube is mounted in a housing and the housing is rotated 360 degrees around a patient to obtain a complete CT image of the patient. The x-ray tube of the CT scanner can be operated for only a short period and then the CT scanner must be turned off for an extended period to cool the anode. Usually, an adequate number of CT slices can not be obtained to form a complete CT image of the patient within the short period before the CT scanner must be turned off to cool the anode. In an emergency situation, doctors may have to wait a long period before they can obtain a complete CT image needed to diagnose and treat the patient. The delay in obtaining the complete CT image may be life threatening to the patient. In non-emergency situations, usually only four patients can be imaged per hour which results in the CT scanner remaining idle for a large portion of the life of the CT scanner. The CT scanner is an expensive piece of equipment and, therefore, it is undesirable to allow the CT scanner to remain idle. Yet another disadvantage of the conventional x-ray tube is the heat generated from the electron beam bombarding the anode degrades the bearings in the rotor and bearing assembly.

Accordingly, the related art does not provide an efficient method and apparatus for cooling an x-ray tube such that the x-ray tube can be continuously used for an extended period without cooling delays. Therefore, the need exists for a method and apparatus for cooling an x-ray tube that permits for continuous generation of x-rays without extended cooling delays, provides for greater cooling than the conventional x-ray cooling apparatus and reduces the complexity of the cooling equipment required to operate an x-ray tube.

BRIEF SUMMARY OF THE INVENTION

The present invention provides an apparatus for cooling a structure using boiling fluid. The apparatus of the present invention has an actuator with a shaft and a fluid passageway connected to the shaft and in thermal communication with the structure.

The present invention provides a heat transfer member comprising a variable conductance shaft in thermal communication with the structure to be cooled and that provides substantially uniform heat flux across the heat transfer surface into the fluid passageway.

The present invention provides an apparatus for cooling an x-ray tube having an anode including an actuator connected to a shaft, a heat transfer member in thermal communication with the anode and having a heat transfer surface, and a fluid passageway connected to the shaft.

The present invention also provides a method of cooling a structure having the steps of transmitting boiling fluid through a passageway that is in thermal communication with the structure such that the heat from the structure is carried away from the structure by the fluid; and imparting a centrifugal force on the fluid such that the centrifugal force acting on the boiling fluid causes the non-bubbling fluid to come into thermal communication with the heat transfer surface and thus, raises the critical heat flux of the fluid.

The present invention solves problems experienced with the cooling of x-ray tubes by applying a centrifugal force to a boiling fluid being transported through a passageway that is in thermal communication with the anode to be cooled such that the critical heat flux of the fluid is raised. Those and other advantages and benefits of the present invention will become apparent from the description of the embodiments hereinbelow.

BRIEF DESCRIPTION OF THE SEVERAL VIEWS OF THE DRAWINGS

For the present invention to be clearly understood and readily practiced, the present invention will be described in conjunction with the following figures, wherein.

DETAILED DESCRIPTION OF THE INVENTION

The present invention will be described below in terms of an x-ray tube. It should be noted, however, that describing the present invention in terms of an x-ray tube is for illustrative purposes and the advantages of the present invention may be realized using other structures and technologies that have a need for an apparatus and method for cooling a structure.

It is to be further understood that the figures and description of the present invention have been simplified to illustrate elements that are relevant for a clear understanding of the present invention, while eliminating, for purposes of clarity, other elements and/or descriptions thereof found in a typical x-ray tube. Those of ordinary skill in the art will recognize that other elements may be desirable in order to implement the present invention. However, because such elements are well known in the art and because they do not facilitate a better understanding of the present invention, a discussion of such elements is not provided herein.

Figure 1:
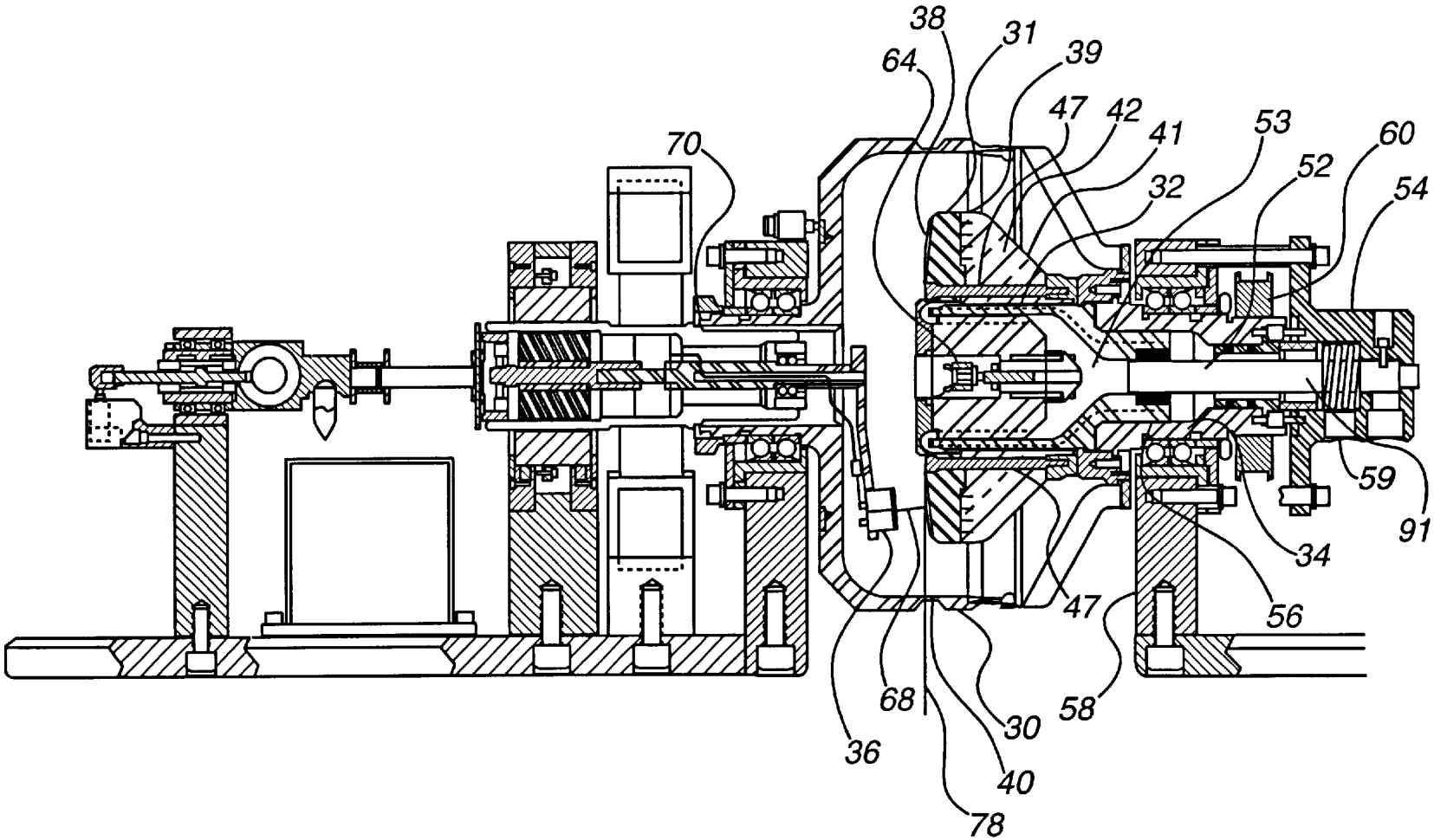
FIG. 1 is a cross-sectional view of an x-ray tube that employs the cooling apparatus of the present invention.
Figure 2:
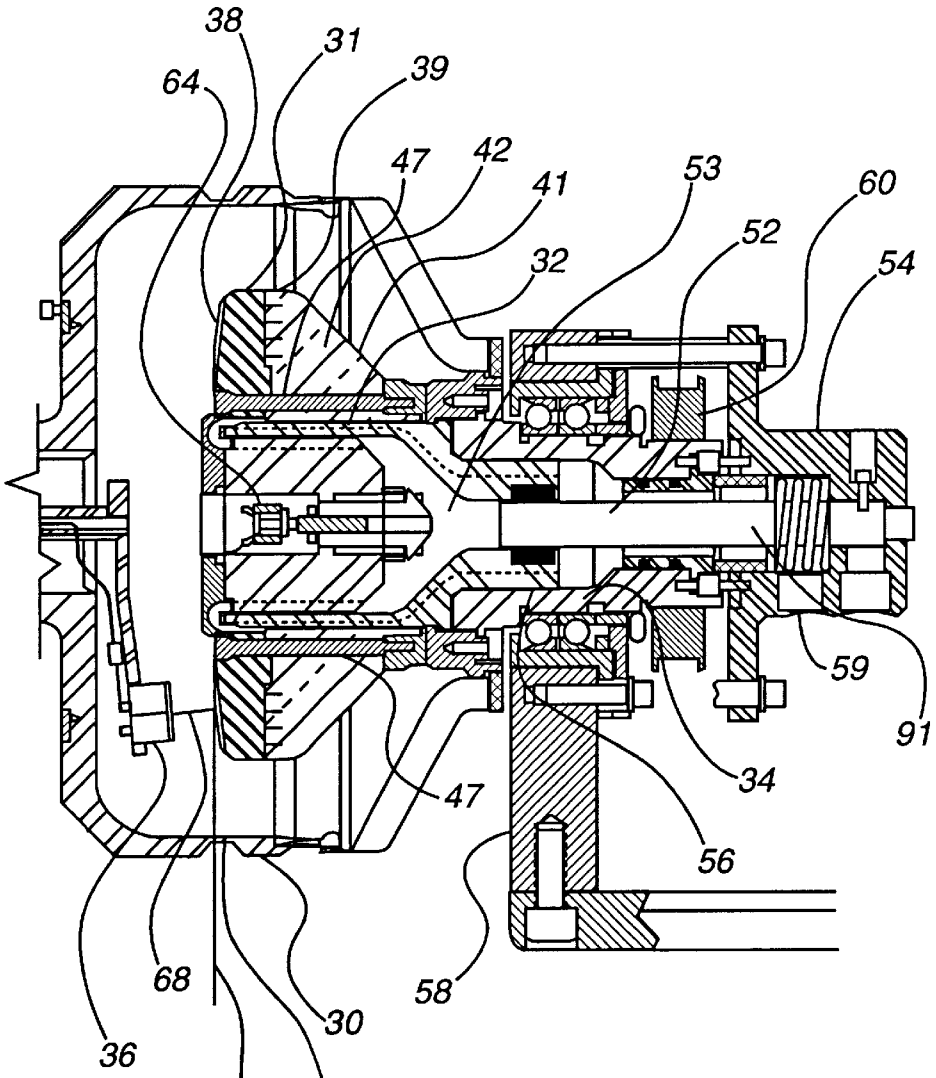
FIG. 2 is an enlarged view of the cooling apparatus of the x-ray tube shown in FIG. 1.

FIGS. 1 and 2 illustrate an x-ray tube that employs one embodiment of the cooling apparatus of the present invention. FIG. 1 is a cross-sectional view of the x-ray tube employing the cooling apparatus of the present invention and FIG. 2 is an enlarged view of the cooling apparatus of the x-ray tube, shown in FIG. 1. The x-ray tube includes an outer housing 30, a cooling assembly generally designated as 32, a rotor and bearing assembly generally designated as 34, an electron gun 36, an anode 38, and an x-ray window 40. The rotor and bearing assembly 34 has a hollow shaft 52 that is connected at one end portion to a motor (not shown) by a belt drive pulley 60 for imparting rotational movement to the shaft 52. The shaft 52 is connected at its other end portion to a heat transfer member 42. The components of the x-ray tube may be constructed from a variety of materials. For example, the shaft 52 may be made of any material that exhibits mechanical strength, can be exposed to high temperatures and be placed in a vacuum without any adverse affects on the present invention. Examples of such materials are stainless steel and kovar, which is an alloy of cobalt, nickel and iron. Also, the outer housing 30 may be made of stainless steel and the x-ray window 40 may be made of aluminum.

Figure 3B:
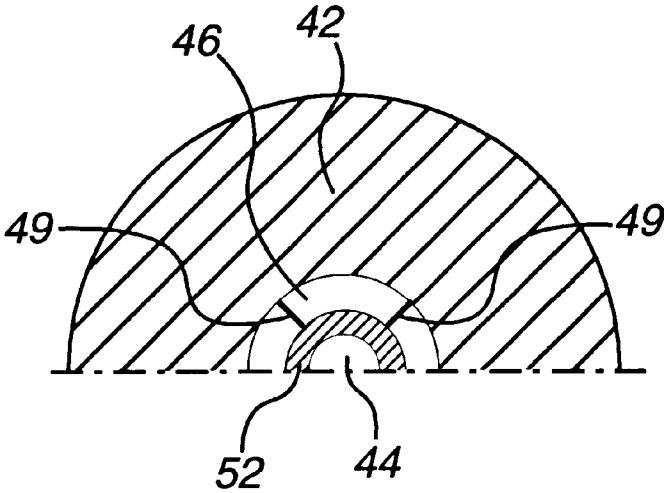
FIG. 3*b* is a sectional view of the cooling apparatus shown in FIG. 3*a* taken along line 3*b*—3*b*.
Figure 3A:
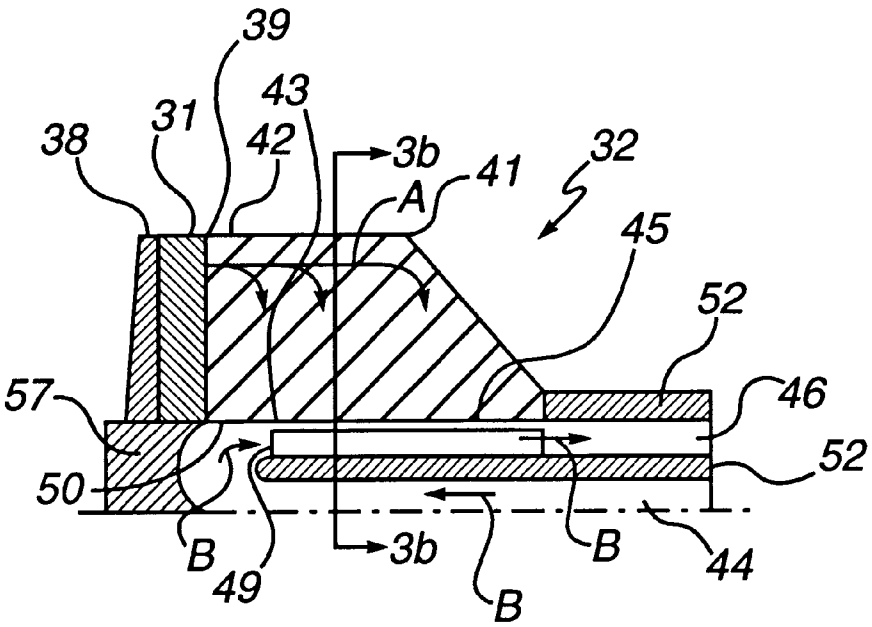
FIG. 3*a* is a partial view of a schematic of the cooling apparatus of the x-ray tube shown in FIG. 2.

FIGS. 3*a* and 3*b* are schematics of the cooling assembly 32 of FIG. 1. FIGS. 3*a* and 3*b* only illustrate the upper longitudinal half of the cooling assembly 32 for purposes of clarity. The illustrated embodiment of the cooling assembly 32 is symmetrical about its longitudinal axis. The cooling assembly 32 includes a heat transfer member 42, a fluid passageway having an inner coolant duct 44 and an outer coolant duct 46. As illustrated in FIG. 3*b*, the outer coolant duct 46 may be divided into four parallel paths by four radial partitions 49 in order that the coolant rotates with the shaft when the shaft 52 is rotated. A coolant is pumped through the inner and outer coolant ducts 44 and 46 such that it follows the path of arrows B, shown in FIG. 3*a*. Please note that only two of the four radial partitions 49 are shown in FIG. 3*b*.

The heat transfer member 42 has a heat transfer surface 50 that defines a portion of the outer boundary of the outer coolant duct 46. The heat transfer member 42 is connected to the shaft 52 at the end 41 of the heat transfer member 42 that is distal to the anode 38 and is connected to an intermediate body 31 at the end 39 of the heat transfer member 42 that is proximate to the anode 38. The intermediate body 31 is connected between the anode 38 and the heat transfer member 42. Fasteners 47, shown in FIGS. 1 and 2 connects the intermediate body 31 and the heat transfer member 42 to the shaft 52. The anode 38 and the intermediate body 31 are also attached to an end member 57. The inner and outer coolant ducts 44 and 46, illustrated in hidden lines in FIGS. 1 and 2, are in fluid communication with the hollow portion 53 of the shaft 52. The inner and outer ducts 44 and 46 are also parallel and concentric to each other. Other fluid passageway configurations which provide for the coolant to come into thermal communication with the heat transfer surface 50 can also be used in the cooling apparatus of the present invention. The components of the cooling apparatus may be constructed from a variety of materials. For example, the anode 38 may be made of tungsten, the intermediate body 31 may be made of an alloy of titanium, zirconium and molybdenum (TZM), and the end member 57 may be made of copper.

The coolant may be a flurochemical such as FC-40 or FC-77 which have boiling temperatures at one atmosphere (1 atm) of 150 degrees Celsius (° C.), and 100 degrees Celsius (° C.), respectively; however, the coolant can be any coolant that exhibits the characteristics of a boiling fluid, wherein a boiling fluid is defined, for the purposes of this application, as any fluid that boils at the operative temperature range of the structure being cooled, has high latent heat at vaporization, and does not decompose or undergo any chemical change at the operative temperature range of the structure being cooled. In the case where the present invention is used in an x-ray tube, the boiling fluid is a dielectric (i.e., an electrical insulator) that will not conduct the electricity from the electron beam. Other properties of the boiling fluid that may be important depending on the application of the cooling apparatus of the present invention are viscosity and thermal conductivity. Other possible examples of boiling fluids are water and alcohol depending on the above factors.

The coolant enters the cooling apparatus through the coolant union 54 and travels through the hollow portion 53 of the shaft 52 to the inner coolant duct 44 and then to the outer coolant duct 46 where it comes into thermal communication with the heat transfer surface 50. As stated above, the movement of the coolant follows the direction of arrows B, shown in FIG. 3*a*. The radial partitions 49 assure that the coolant rotates at the same rate as the anode 38. Although not illustrated, the radial partitions 49 can take many forms and may be constructed to alter the turbulence of the coolant moving through the outer coolant duct 46.

Figure 6:
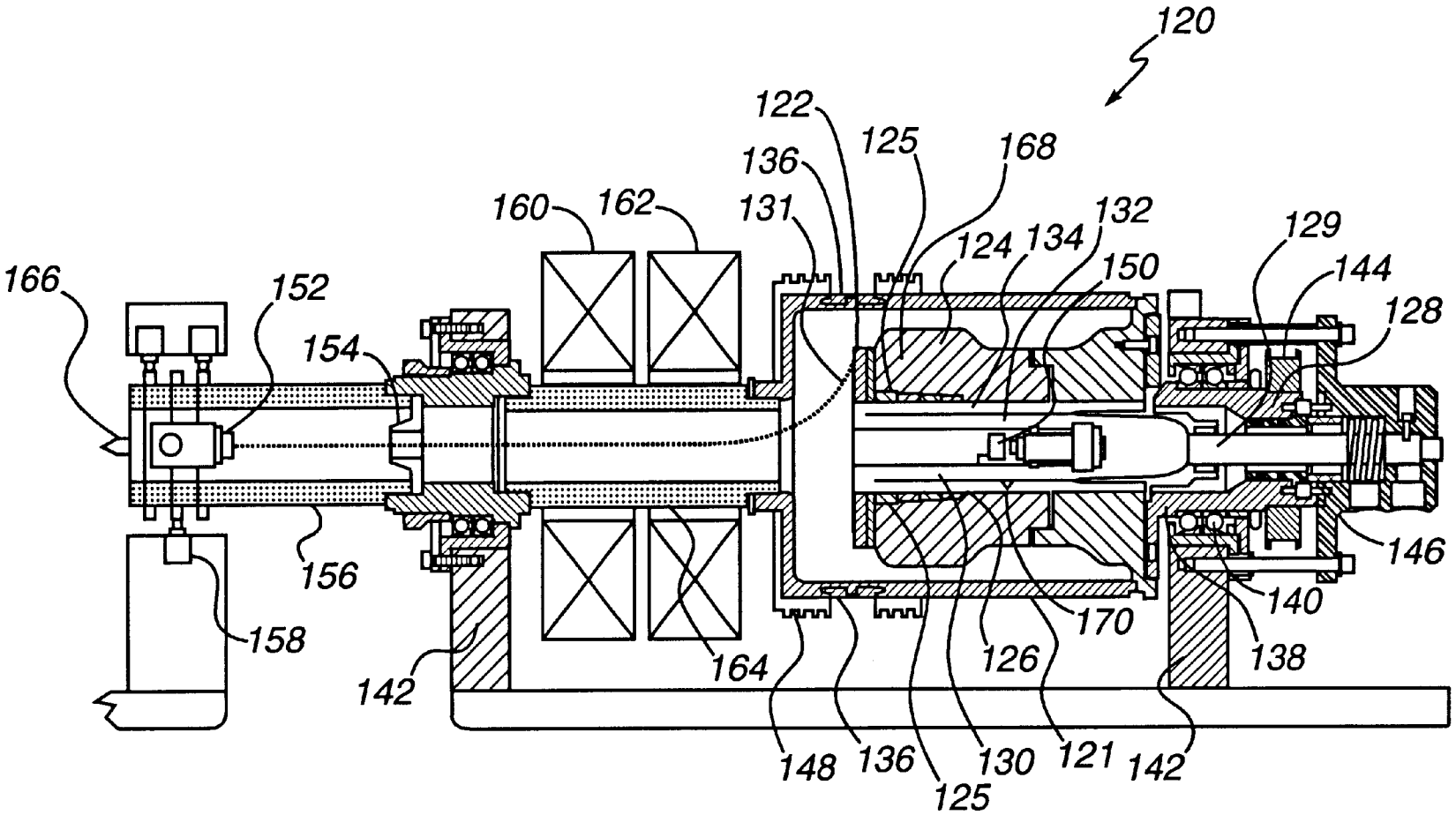
FIG. 6 is a cross-sectional view of an x-ray tube having a magnetically deflected electron beam and employing the cooling apparatus of the present invention.

The heat transfer member 42 is a variable conductance shaft which provides for substantially uniform heat flux across the heat transfer surface 50 into the outer coolant duct 46, wherein the path of the heat flux is denoted by arrows A. The heat flux A at 43 is approximately the same as the heat flux A at 45. For purposes of this application, a variable conductance shaft is a member, wherein the combination of the geometric configuration and the thermal conductivity of the variable conductance shaft provides that all heat transfer paths, whether long or short, that travel through the variable conductance shaft have the same temperature drop for the same power density. The variable conductance shaft is made of a dispersion strengthened copper with approximately 0.2% aluminum oxide. The dispersion strengthened copper with approximately 0.2% aluminum oxide is sold by Glidden Paint Company under the tradename GLIDCOP. GLIDCOP has a high thermal conductivity. The heat transfer member 42 has a substantially triangular cross-section, shown in FIG. 2, that decreases as one moves away from the anode 38 (i.e., moves from the heat transfer member proximate end 39 to the heat transfer member distal end 41). The geometric configuration of the heat transfer member 42 in combination with the material of the heat transfer member 42 dictate the heat transfer characteristics of the heat transfer member 42. Many combinations of different geometric configurations of the heat transfer member 42 and different heat transfer member materials having different thermal conductivities can be used to provide the substantially uniform heat flux A. For instance, the heat transfer member 42 may also take the form of a plurality of members with different geometric configurations and different materials that taken together provide desired heat transfer characteristics. This type of heat transfer member 42 is illustrated in FIGS. 6 through 8 and will be discussed hereinafter.

The heat transfer member 42 is in thermal communication with the anode 38 such that the heat from the anode 38 is transported through the intermediate body 31 to the heat transfer member 42. The heat transfer surface 50 forms the thermal interface between the anode 38 and the coolant, wherein for purposes of this application, the thermal interface is where the heat from the anode 38 is transferred to the coolant which is then transported through the outer coolant duct 46.

In operation, the electron gun 36 emits an electron beam 68 that contacts the anode 38 and creates x-rays 78. The anode 38 is rotated at approximately 10,000 revolutions per minute (rpm) such that the electron beam 68 is distributed over the surface of the anode 38. The electron beam 68 striking the anode 38 increases the temperature of the anode 38. The heat travels from the anode 38, through the intermediate body 31, to the heat transfer member 42 following path A. The heat then exits the heat transfer member 42 at the heat transfer surface 50 where it enters the outer coolant duct 46. As stated above, the outer coolant duct 46 has coolant passing therethrough. The coolant comes into physical contact and thermal communication with the heat transfer surface 50 resulting in the heat being absorbed by the coolant via conduction and convection and then being is carried away in the direction of arrows B.

As the temperature of the coolant increases due to the heat being transferred thereto, nucleating bubbles of the coolant are formed at the heat transfer surface 50. These nucleating bubbles are replaced by non-bubbling coolant as a result of turbulence caused by the boiling of the coolant and the movement of the coolant through the inner and outer coolant ducts 44 and 46. However, if the critical heat flux of the coolant is reached, the nucleate boiling changes to film boiling and the amount of heat transferred from the anode 38 to the coolant decreases. For purposes of this application, the critical heat flux is reached when the vapor bubbles of the coolant cover the heat transfer surface 50 and the non-bubbling fluid is prevented from contacting the heat transfer surface 50 which results in the coolant not being able to transport heat away from the structure being cooled. If the coolant would reach its critical heat flux, the coolant would form an insulating layer of nucleating bubbles within the outer duct 46 at the heat transfer surface 50 which would prevent the heat from being easily transferred to the coolant traveling through the outer coolant duct 46. However, the rotation of the shaft 52 raises the critical heat flux thus, preventing film boiling. Specifically, the centrifugal force acts on the coolant traveling through the outer coolant duct 46 such that the coolant in a liquid state (i.e., non-bubbling coolant), which is more dense than the bubbling coolant, is forced outwardly against the heat transfer surface 50 where its weight collapses the vapor bubbles of the bubbling coolant and extracts more heat from the heat transfer member 42. It should be noted that the heat transfer member 42 changes the direction of the heat path A from being parallel to the heat transfer surface 50 when it exits the anode 38 to being perpendicular to the heat transfer surface 50 when it enters the coolant in the outer coolant duct 46. By changing the direction of the heat path A, the heat is distributed across the heat transfer surface 50 which provides a sufficient surface area for the heat to be transferred to the coolant. This change in the orientation of the heat path A results in the heat transfer being enhanced by an order of magnitude over the conventional x-ray cooling apparatus. Other advantages of the present invention are the high latent heat of vaporization resulting in a high rate of heat transfer and the rotation increasing the coolant pressure at the heat transfer surface 50 which further raises the critical heat flux of the coolant.

The x-ray tube shown in FIGS. 1, 2, 3*a* and 3*b* has the following additional components: an anode and bearing support shaft 56, a bearing pillow block 58 which supports the x-ray tube, a non-evaporable getter 64, and a high voltage ceramic insulator 70. The anode and bearing support shaft 56 is made of steel and is attached mechanically to the x-ray tube. The non-evaporable getter 64 is a standard commercially available getter for pumping gas that emanates from internal parts of the x-ray tube during operation.

Figure 4B:
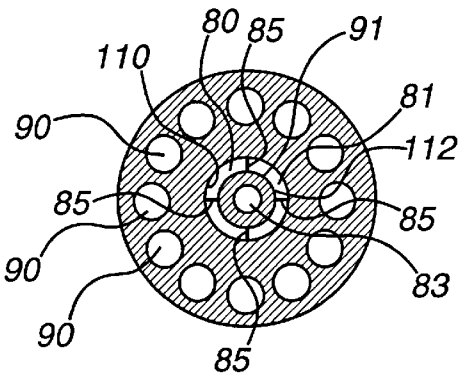
FIG. 4*b* is a sectional view of the thermal and mechanical mockup of the x-ray tube shown in FIG. 4*a* taken along line 4*b*—4*b*.
Figure 4A:
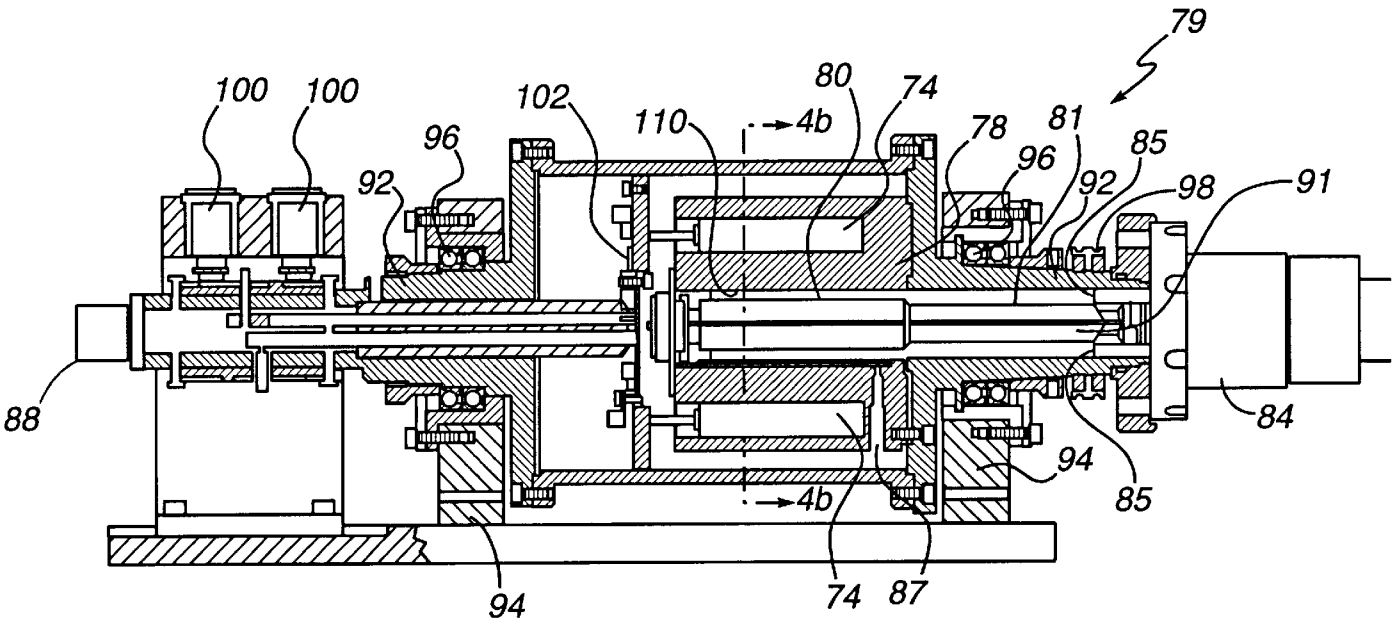
FIG. 4*a* is a cross-sectional view of a thermal and mechanical mockup of an x-ray tube that was used to test the cooling apparatus of the present invention.

FIGS. 4*a* and 4*b* illustrate a thermal and mechanical mockup 79 of an x-ray tube that was used to evaluate the cooling apparatus of the present invention. The mockup 79 was comparable to the x-ray tube shown in FIGS. 1, 2, 3*a* and 3*b* in that it had substantially the same size, weight, rotation bearings, and cooling ducts of the x-ray tube shown in FIGS. 1, 2, 3*a* and 3*b*. Specifically, the mockup 79 weighed approximately fifty pounds (50 lbs.). One difference between the mockup 79 and the x-ray tube of FIGS. 1, 2, 3*a* and 3*b* is that heat was supplied by resistive heaters 74 rather than caused by the electron beam bombarding the anode.

The thermal and mechanical mockup 79 substantially comprised a dummy core 78 made of copper to simulate the weight of the anode and the heat transfer member, a rotating coolant union 84 attached to a rotating shaft 91, thermocouple probes (not shown) received in openings 87 and resistive heaters 74, shown in FIG. 4*a*. For purposes of clarity the resistive heaters 74 are not shown in FIG. 4*b*. The core 78 defined twelve cylindrical recesses 90, shown in FIG. 4*b*, positioned in a circle which received the resistive heaters 74 and a heat transfer surface 110 which formed a central cavity 80. The shaft 91 defined an inner coolant duct 83 which extends longitudinally within the shaft 91 and is in fluid communication with the coolant union 84. An outer coolant duct 81 was defined by and extended between the heat transfer surface 110 and the exterior surface 112 of the shaft 91. The outer coolant duct 81 was in fluid communication with the inner coolant duct 83 and the coolant union 84. The outer coolant duct 81 was divided by four radial partitions 85, each of which extended radially between and are connected to the exterior surface 112 of the shaft 91 and the heat transfer surface 110. The outer coolant duct 81 had an outer diameter of 1.44 inches and a length inside the core 78 of 4.48 inches. The heat transfer surface 110 had a surface area of 21.2 square inches. The mockup 79 also had a canister 92, pillow blocks 94, main bearings 96, a rotational pulley 98, power brushes 100, a thermocouple slip ring assembly 88 and a power distribution board 102.

Twelve resistive heaters 74 each supplying 2 kW of power were used to provide the 24 kW of power needed to simulate the heat generated from an electron beam bombarding the anode of an x-ray tube, wherein each resistive heater 74 works at 240 VAC, 8.3 amp and 60 Hz. The power distribution board 102 provided AC power from the power brushes 100 to each individual resistive heater 74. A motor (not shown) was connected to the shaft 91 and core 78 by the drive belt pulley 98 which resulted in the rotation of the core 78 and shaft 91 simulating the rotation of an anode and shaft of an x-ray tube. The coolant union 84 distributed the coolant through the outer coolant duct 81 where it passed along the heat transfer surface 110, through the inner coolant duct 83 and then back to the coolant union 84. The heat from the resistive heaters 74 traveled through the core 78, across the heat transfer surface 110, to the coolant passing through the outer coolant duct 81. The coolants used for testing were two high dielectric strength flurochemical coolants, FC-40 and FC-77.

Testing of the thermal and mechanical mockup 79 provided for adjustment of the rotational speed of the core 78 and the shaft 91, the power of the resistive heaters 74 and the coolant flow rate. A conventional computerized data acquisition system was used to provide an on-screen display of the coolant flow, the power input, the rotational speed of the core 78 and the shaft 91, six thermocouple temperature readings which consisted of inlet and outlet coolant temperatures, three temperatures of the core 78 and the bearing temperature as well as the inlet and outlet coolant pressures.

The mockup 79 rotated satisfactorily during testing at all rotational speeds up to and including 10,000 rpm. No resonant frequencies were observed at any of these rotational speeds. At 10,000 rpm, the mechanical power of the motor required to drive the mockup was 1100 watts (1.5 hp). This power was required to overcome the friction created in the main bearings 96, the friction created in the coolant union 84, and wind friction. When the input power was 21.2 kW the power density at the heat transfer surface 110 was 1000 watts/in$^2$. When the total power dissipated reached 24 kW, the power density at the heat transfer surface 110 was 1100 watts/in$^2$. The total pressure drop of the coolant through the mockup 79, including the inner and outer coolant ducts 83 and 81 and the coolant union 84 was less than 10 psi at a flow rate of 5 gallons per minute (GPM) and at the maximum rotation speed of 10,000 rpm. This low pressure drop allows the use of a small, low power, quiet centrifugal pump, of the same type used in existing CT scanners. One example of such a pump is a conventional magnetic driven pump made by March Pump Company and identified as model number AC5CMD which weighs nine pounds, has a maximum pump pressure of 10 psi and pumps at 14.5 GPM.

Figure 5:
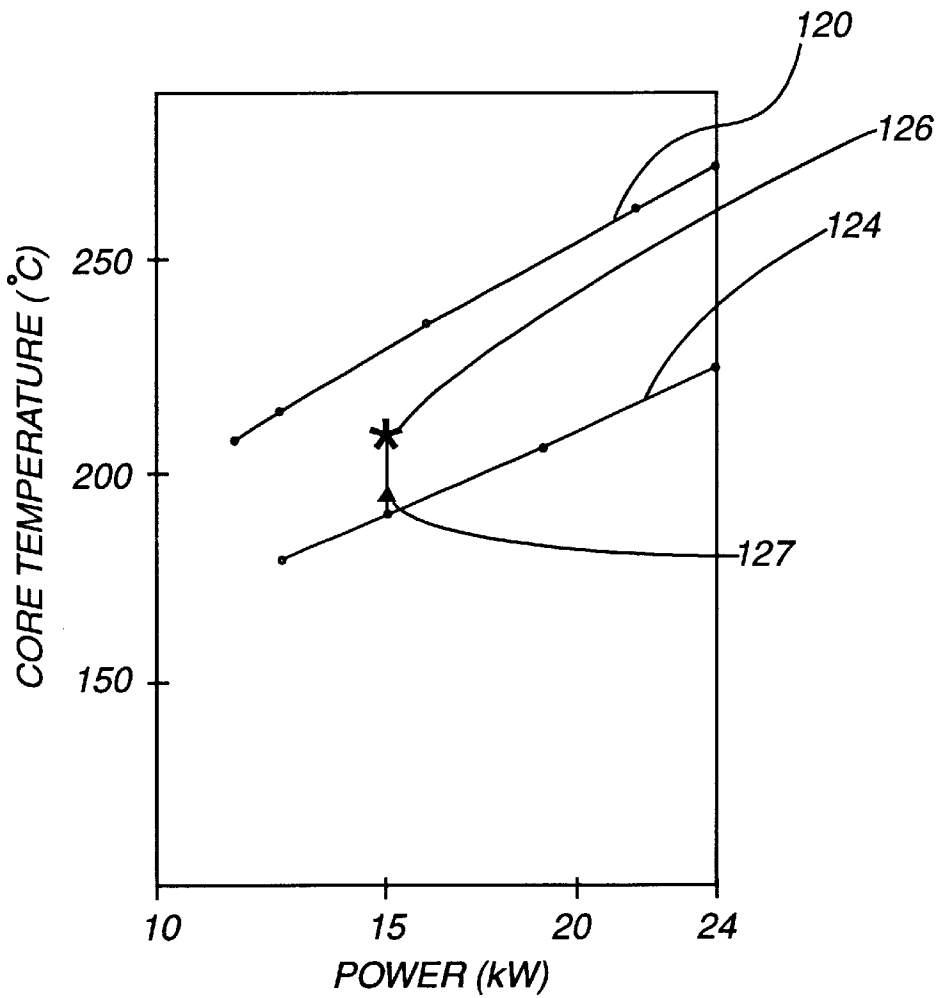
FIG. 5 is a graph that plots the core temperature of the thermal and mechanical mockup of the x-ray tube shown in FIG. 4*a* as a function of the power dissipated for two high dielectric strength flurochemical coolants.

FIG. 5 illustrates the temperature of the core 78 at the heat transfer surface 110 as a function of the power dissipated by the resistive heaters 74 for two high dielectric strength fluorochemical coolants, FC-40 and FC-77, which have boiling temperatures at one atmosphere (1 atm) of 155° C. and 100° C., respectively. The set of data identified with reference numeral 120 represents the data concerning FC-40 and the set of data identified with reference numeral 124 represents the data concerning FC-77. These coolants can be mixed together to provide any boiling temperature within the range of temperatures mentioned above. The core temperature was taken by one of the six thermocouples previously noted. The flow rate of the coolants were 5 GPM and the rotational speed of the shaft 91 and core 78 was 7000 rpm during testing.

Using the cooling method of the present invention, the coolant flowing through the inner and outer coolant ducts 83 and 81 operated below the boiling temperatures of the respective coolant while the heat transfer surface 110 was operating above the boiling temperature of the respective coolants. As can be seen from FIG. 5, as power to the resistive heaters 74 was increased, the core temperature at the heat transfer surface 110 was constant over time at the specific powers indicating that the heat transferred from the resistive heaters 74 to the core 78 was being transferred to the coolants and carried away through the inner and outer coolant ducts 83 and 81, because there was not an increase of core temperature over time. If the heat generated by the resistive heaters 74 was not being transferred to the coolant, the heat would build up in the core 78 and cause the core temperature to increase at a specific power and FIG. 5 would have multiple core temperatures plotted for a specific power.

Keeping in mind that fluid temperature increases with an increase in pressure, the boiling temperatures of both coolants were higher than the above noted boiling temperatures at 1 atm, because the rotation and the pressure drop through the mockup 79 increased the pressure by 1 atm. To verify the effect of pressure on the coolant boiling temperature and core temperature, the pressure within the mockup was deliberately raised by adding a valve to the external system. As shown by the starred point 126 in FIG. 5, this increase in pressure caused the core temperature to rise.

When the total power dissipated reached 24 kW, the power density at the heat transfer surface 110 was 1100 watts/in$^2$. The critical heat flux was exceeded if the rotational speed of the core 78 was below 2500 rpm. This fact was observed by slowly lowering the rotational speed and measuring the temperature as a function of time. If the rotational speed was below 2500 rpm, the core temperature would not stabilize. If the rotational speed was above 2500 rpm, the core temperature was not very sensitive to either rotation speed or coolant flow rate.

The thermal and mechanical mockup 79 was rebuilt to evaluate the method and apparatus for cooling of the present invention at higher power densities. The rebuilt mockup (not shown) was substantially identical to the mockup 79 shown in FIGS. 4*a* and 4*b* having the same maximum power of 24 kW from the resistive heaters 74, but differed in that stainless steel bars were inserted into the heat transfer surface 110 to reduce the heat transfer area to 10 square inches, (i.e., half of the original value of the area of the heat transfer surface which was 21.2 square inches). One of the data points is shown as the triangular point 127 in FIG. 5. Note, at twice the power density of the original mockup 79 (i.e., 1500 watts/in$^2$) and with flow and rotational conditions the same, the temperature of the core 78 at the heat transfer surface 110 was not substantially increased. This indicates that as long as the rotation speed is high enough, the critical heat flux will not be exceeded and the core temperature at the heat transfer surface 110 is independent of the heat flux and depends only on coolant type and internal pressure, both of which determine the boiling temperature and critical heat flux of the coolant.

Figure 7B:
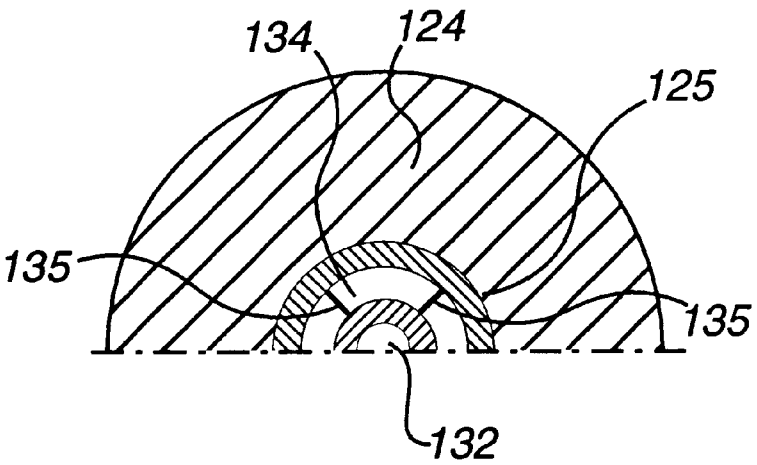
FIG. 7*b* is a sectional view of the cooling apparatus shown in FIG. 7*a* taken along line 7*b*—7*b*.
Figure 7A:
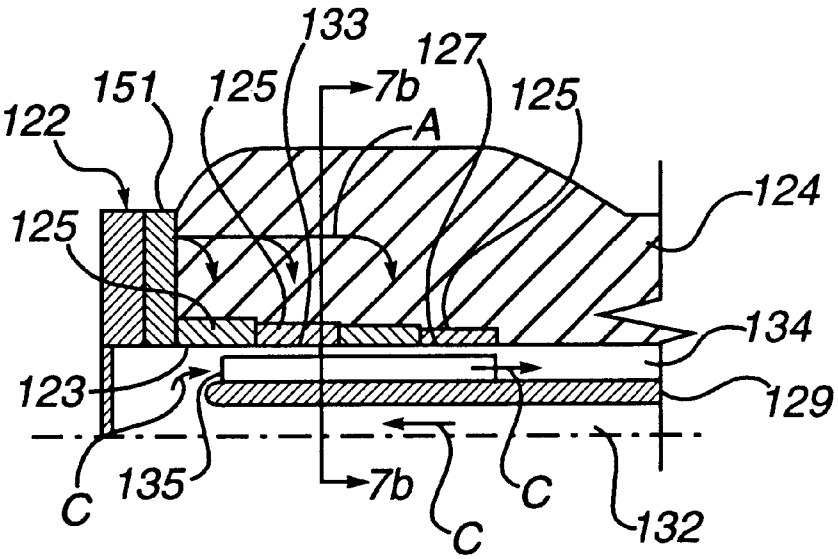
FIG. 7*a* is a partial view of a schematic of the cooling apparatus used in the x-ray tube shown in FIG. 6.
Figure 8:
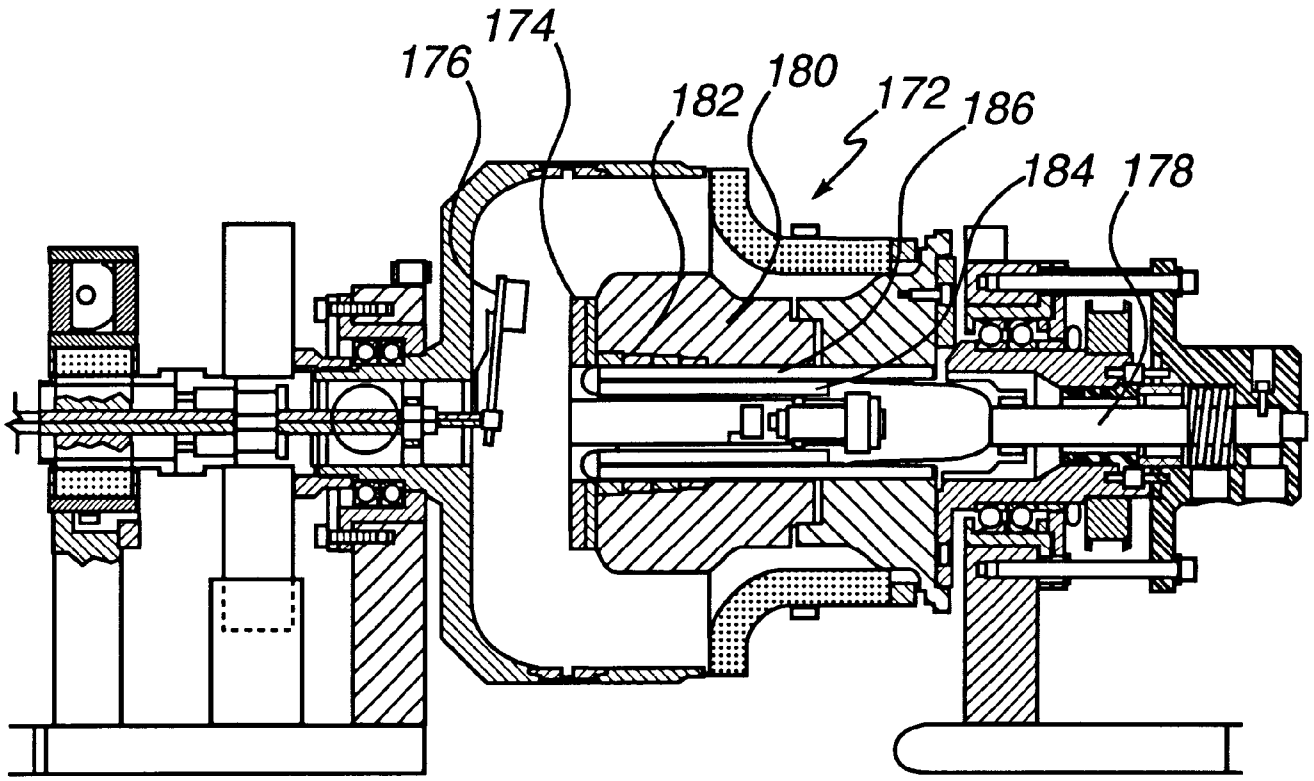
FIG. 8 is a cross-sectional view of another x-ray tube having a mechanical despun gun and employing the cooling apparatus shown in FIGS. 7*a* and 7*b*.

FIGS. 6, 7*a* and 7*b* illustrate another x-ray tube 120 having a magnetically deflected electron beam 131 and employing the cooling apparatus of the present invention designated generally as 168. The x-ray tube 120 substantially comprises a housing 121, an anode 122, a heat transfer member 124 being a variable conductance shaft, a rotor and bearing assembly designated generally as 128. A shaft 129 is part of the rotor and bearing assembly 128. A fluid passageway having an inner coolant duct 132 and an outer coolant duct 134 is defined by the shaft 129 and the heat transfer member 124. The heat transfer member 124 is GLIDCOP and various thickness stainless steel rings 125. An intermediate body 151 made of TZM is connected between the anode 122 and the heat transfer member 124. GLIDCOP has a high thermal conductivity that is similar to that of copper whereas, stainless steel has a low thermal conductivity. By varying the sizes and proportions of the stainless steel rings 125 and thus, the amount of stainless steel relative to GLIDCOP to form the heat transfer member 124, the thermal conductivity and heat transfer path can be adjusted so that longer paths have the same temperature drops to that of shorter paths for the same power density. This results in the heat flux designated by arrows A in FIG.

7*a* and power density across the heat transfer surface 123 being substantially uniform. The heat flux A at 127 is substantially the same as that at 133.

The cooling apparatus generally designated as 168 and shown in greater detail in FIGS. 7*a* and 7*b* substantially comprises the heat transfer member 124 with stainless steel rings 125 and a heat transfer surface 123, the inner and outer coolant ducts 132 and 134 and a coolant flowing through the inner and outer coolant ducts 132 and 134 which path is designated by arrows C. The interior surfaces of the stainless steel rings 125 define the heat transfer surface 123 which is the outer boundary of the outer coolant duct 134. The outer coolant duct 134 has four radial partitions 135 that extend between and are connected to the stainless steel rings 125 and the shaft 129 and that separate the outer coolant duct 134 into four longitudinal spaces. The radial partitions 135 provide for the coolant to rotate at the same rate as the anode 122.

The cooling apparatus 168 shown in FIGS. 6, 7*a* and 7*b* operates similar to the cooling apparatus shown in FIGS. 1, 2, 3*a* and 3*b*. The hollow shaft 129 is connected at one end thereof to a motor (not shown) by a belt driving pulley 144 which imparts rotational movement to the shaft 129. The shaft 129 is connected at its other end to the heat transfer member 124. The inner and outer coolant ducts 132 and 134 are formed such that they are in fluid communication with each other and also with the coolant union 146. The inner and outer ducts 132 and 134 are concentric and are separated by part of the shaft 129.

In operation, the coolant enters the cooling apparatus 168 through the coolant union 146 and travels to the inner coolant duct 132 and then to the outer coolant duct 134 where it is in thermal communication and physical contact with the heat transfer surface 123, as indicated by arrows C. The magnetically deflected electron beam 131 contacts the anode 122 and creates x-rays. The electron beam 131 striking the anode 122 increases the temperature of the anode 122 and the heat generated therefrom travels from the anode 122 through the intermediate body 151 and the heat transfer member 124 following path A, shown in FIG. 7*a*. The heat then exits the heat transfer member 124 at the heat transfer surface 123 and enters the outer coolant duct 134. The coolant in the outer coolant duct 134 absorbs the heat by conduction and convection and carries the heat away from the anode 122 in the direction of arrows C, shown in FIG. 7*a*. Nucleating bubbles of the coolant are formed at the heat transfer surface 123. These nucleating bubbles are replaced by non-bubbling coolant as a result of the turbulence caused by the boiling of the coolant and the movement through the inner and outer coolant ducts 132 and 134 of the coolant. Normally, when the critical heat flux would be reached and the nucleate boiling would change to film boiling and the amount of heat transfer from the anode 122 to the coolant would decrease, because the coolant would form a layer of vapor bubbles along the heat transfer surface 123 which acts as an insulator. However, the rotation of the shaft 129 raises the critical heat flux thus, preventing film boiling. Specifically, the centrifugal force acting on the coolant traveling through the outer coolant duct 134 moves the coolant in a liquid state (i.e., the non-bubbling coolant) against the heat transfer surface 123 such that the weight of the non-bubbling coolant collapses the vapor bubbles and the non-bubbling coolant can extract more heat from the heat transfer surface 123.

The x-ray tube 120 further substantially comprises the following standard components: an aluminum x-ray window 136, anode and bearing shaft support 138, main bearings 140, bearing pillow blocks 142, air cooling fins 148, a non-evaporable getter 150, an electron gun 152, a high voltage accelerating anode 154, a high voltage ceramic insulator 156, a slip ring assembly 158, an external magnetic focusing coil 160, an external magnetic deflection coil 162, a ceramic vacuum envelope 164 and an exhaust tabulation 166.

FIG. 8 illustrates yet another x-ray tube 172 employing the cooling apparatus of the present invention illustrated in FIGS. 6, 7*a* and 7*b* and having a mechanical despun gun 176. The cooling apparatus substantially comprises an anode 174, a hollow shaft 178, a fluid passageway with an inner coolant duct 184 and an outer coolant duct 186, a heat transfer member 180, and a coolant (not numbered). This cooling apparatus is the same functionally and structurally to that illustrated in FIGS. 6, 7*a* and 7*b* and therefore, it will not be described again. This embodiment reveals that the cooling apparatus of the present invention can be used in a variety of x-ray tubes.

The cooling apparatus and method of the present invention could be applied to other technologies such as gas turbines, electrical motors and generators having a surface to be cooled. Those of ordinary skill in the art will recognize that many other modifications and variations of the present invention may be implemented. The foregoing description and the following claims are intended to cover all such modifications and variations.

What is claimed is:

1. A rotating apparatus comprising a cooling assembly for cooling a heated portion of the rotating apparatus, said cooling assembly having an axis of rotation and a longitudinally extending passageway disposed about said axis of rotation, said passageway having a fluid inlet and a fluid outlet, said cooling assembly having at least one radial partition disposed within said passageway, said radial partition configured to cause fluid within said passageway to rotate with said cooling assembly, said cooling assembly further comprising a thermally conductive member disposed circumferentially about and defining at least a portion of said passageway, said thermally conductive member in thermal communication with said passageway and with said heated portion of the rotating apparatus.

2. The rotating apparatus of claim 1 wherein said cooling assembly further comprises a shaft disposed along said axis of rotation and at least partially within the passageway of said cooling apparatus, said shaft having an outer surface and having an inner fluid duct having an outlet communicating with said fluid inlet of said passageway, a space between said outer surface of said shaft and said thermally conductive member defining an outer fluid duct and at least a portion of said passageway, said radial partition extending across said outer fluid duct and between said outer surface of said shaft and said thermally conductive member.

3. The rotating apparatus of claim 2 wherein said radial partition extends from said outer surface of said shaft to said thermally conductive member to divide said outer fluid duct into a plurality of ducts.

4. The rotating apparatus of claim 1 wherein a surface of said heated portion of the rotating apparatus is substantially perpendicular to said axis of rotation.

5. The rotating apparatus of claim 1 wherein said heated portion of the rotating apparatus is an anode of an x-ray tube.

6. The rotating apparatus of claim 2 wherein said thermally conductive member has a heat transfer surface that defines a portion of an outer boundary of said outer fluid duct, said heat transfer surface being substantially parallel to said axis of rotation and substantially perpendicular to a surface of said heated portion of the rotating apparatus.

7. The rotating apparatus of claim 1 wherein said thermally conductive member is having variable thermal conductance.

8. The rotating apparatus of claim 1 wherein said thermally conductive member comprises at least one stainless steel member and a dispersion strengthened copper including aluminum oxide.

9. The rotating apparatus of claim 8 wherein said thermally conductive member has a heat transfer surface that defines a portion of an outer boundary of said outer fluid duct, said stainless steel member defining at least a portion of said heat transfer surface.

10. The rotating apparatus of claim 8 wherein said thermally conductive member is having variable thermal conductance.

11. The rotating apparatus of claim 8 comprising a plurality of said stainless steel members and wherein said stainless steel members are rings of varying diameters.

12. The rotating apparatus of claim 1, further comprising an intermediate body connected to and positioned between said thermally conductive member and said heated portion, wherein said intermediate body is an alloy comprising titanium, zirconium, and molybdenum.

13. The rotating apparatus of claim 1 wherein said thermally conductive member comprises a dispersion strengthened copper including aluminum oxide.

14. The rotating apparatus of claim 13 wherein said dispersion strengthened copper includes about 0.2% aluminum oxide.

15. The rotating apparatus of claim 1, further comprising a fluid in said passageway.

16. The rotating apparatus of claim 15 wherein said fluid is at least one of FC-40 and FC-77.

17. The rotating apparatus of claim 15 wherein said fluid is at least a portion of one of alcohol and water.

18. The rotating apparatus of claim 1 wherein said at least a portion of passageway has an annular cross section when sectioned substantially perpendicular to said axis of rotation.

19. The rotating apparatus of claim 1 wherein said thermally conductive member has a substantially triangular cross section when sectioned substantially parallel to said axis of rotation.

20. The rotating apparatus of claim 1 comprising four of said radial partitions.

21. A rotating apparatus comprising a cooling assembly for cooling a heated portion of the rotating apparatus, said cooling assembly having an axis of rotation and a longitudinally extending passageway disposed about said axis of rotation, said passageway having a fluid inlet and a fluid outlet, said cooling assembly further comprising a thermally conductive member disposed circumferentially about and defining at least a portion of said passageway, said thermally conductive member having a first surface in thermal communication with said passageway and a second surface in thermal communication with said heated portion of said rotating apparatus, wherein said thermally conductive member is a variable thermal conductance member suitably configured so that heat transferred from said heated portion of said rotating apparatus to said first surface of said thermally conductive member is transferred to said second surface of said thermally conductive member and is distributed substantially evenly over said second surface and to said passageway.

22. The rotating apparatus of claim 21 wherein the surface area of said first surface of said thermally conductive member is less than said surface area of said second surface of said thermally conductive member.

23. The rotating apparatus of claim 21 wherein said thermally conductive member comprises at least two materials of varying thermal conductance.

24. The rotating apparatus of claim 23 wherein said thermally conductive member comprises a dispersion strengthened copper with approximately 0.2% aluminum oxide and one or more stainless steel members.

25. The rotating apparatus of claim 24 wherein said passageway is substantially annular in cross section, perpendicular to said axis of rotation, and said one or more stainless steel members are disposed on at least a portion of the heat transfer surface.

26. The rotating apparatus of claim 25, having a plurality of stainless steel members in which said stainless steel members are rings of various sizes.

27. The rotating apparatus of claim 21 wherein said thermally conductive member comprises a dispersion strengthened copper with aluminum oxide.

28. The rotating apparatus of claim 27 wherein the thermally conductive member has approximately 0.2% aluminum oxide.

29. The rotating apparatus of claim 21 wherein said thermally conductive member has a substantially triangular cross section such that said first surface of said thermally conductive member is substantially perpendicular to said axis of rotation and said second surface of said thermally conductive member is substantially parallel to said axis of rotation.

30. A rotating apparatus comprising a cooling assembly for cooling a heated portion of said rotating apparatus, said cooling assembly having an axis of rotation and a plurality of elongate passageways, each said passageway having an inlet and an outlet, each said passageway disposed about and substantially parallel to said axis of rotation, said cooling assembly further comprising a thermally conductive material defining at least a portion of a wall of each said passageway distal from said axis of rotation, said thermally conductive material being in thermal communication with each said passageway and with said heated portion of the rotating apparatus.

31. A cooling apparatus for an x-ray tube having an anode fixedly attached to a rotatable shaft, the cooling apparatus comprising:

an actuator connected to the shaft;

a heat transfer member in thermal communication with the anode and having a heat transfer surface;

at least one fluid passageway in fluid communication with the shaft and in thermal communication, through said heat transfer member, with the anode; and a plurality of radially extending partitions dividing said passageway into a plurality of passageways and extending outward from the shaft in a direction substantially perpendicular to an axis of rotation of the shaft.

32. An x-ray tube, comprising:

an actuator having a shaft;

at least one fluid passageway in communication with said shaft;

a plurality of radially extending partitions dividing said passageway substantially parallel to a longitudinal axis of the at least one fluid passageway;

an anode operably connected-to said shaft; and a heat transfer member operably connected to said shaft and positioned concentrically about said passageway, said heat transfer member having a heat transfer surface, wherein said heat transfer surface and said shaft define at least a region of said at least one fluid passageway which is in thermal communication with the anode.

33. The x-ray tube according to claim 32, further comprising a fluid within said passageway, wherein the fluid is a flurochemical.

34. The x-ray tube according to claim 32, further comprising an intermediate body connected to and positioned between said heat transfer member and said anode.

35. The x-ray tube according to claim 32, wherein the intermediate body is an alloy comprising titanium, zirconium and molybdenum.

36. A method for cooling a rotating structure having an axis of rotation, the rotating structure having an actuator, a shaft and at least one passageway disposed about the axis of rotation, the passageway communicating with the shaft and in thermal communication with the structure, the passageway partitioned into a plurality of elongate passages, the method comprising:

transmitting a fluid through the at least one passageway so that the fluid is in thermal communication with the structure and heat is transmitted from the structure to the fluid within the at least one passageway and away from the structure; and rotating the structure to impart a centrifugal force to the fluid within the at least one passageway.

37. The method of claim 36 wherein the rotating structure further includes a heat transfer member in thermal communication with the at least one passageway and with a heated surface of the structure to be cooled.

38. The method according to claim 37, further comprising changing the direction of the heat emitted by the structure from substantially parallel to the longitudinal axis of the at least one passageway to substantially perpendicular to the longitudinal axis of the at least one passageway.

39. The method of claim 38 wherein changing the direction of the heat comprises providing the heat transfer member with a heat transfer surface that defines the outer boundary of at least a portion of the at least one passageway such that heat is transferred from heated surface of the structure through the heat transfer member and into a fluid within the at least one passageway through the heat transfer surface.

40. The method of claim 39 wherein the heat transfer member has at least one of valuable thermal conductivity and a geometric configuration providing substantially uniform heat flux at the heat transfer surface.

41. The method of claim 38 wherein the heat transfer member includes at least one annular stainless steel member.

42. The method of claim 37 wherein the heat transfer member is a shaft having variable heat conductance.

43. The method of claim 37 wherein an intermediate member is intermediate and in thermal communication with the structure and heat transfer member wherein the heat passes through the intermediate body member.

44. The method of claim 36 wherein the at least one passageway has an annular cross section when sectioned perpendicular to the axis of rotation.

* * * * *